US006749693B2

(12) United States Patent
Schoen et al.

(10) Patent No.: US 6,749,693 B2
(45) Date of Patent: Jun. 15, 2004

(54) METHOD OF PRODUCING (110)[001] GRAIN ORIENTED ELECTRICAL STEEL USING STRIP CASTING

(75) Inventors: Jerry W. Schoen, Middletown, OH (US); Glenn S. Huppi, Monroe, OH (US)

(73) Assignee: AK Properties, Middletown, OH (US)

( * ) Notice: Subject to any disclaimer, the term of this patent is extended or adjusted under 35 U.S.C. 154(b) by 0 days.

(21) Appl. No.: 10/242,885

(22) Filed: Sep. 13, 2002

(65) Prior Publication Data

US 2003/0155040 A1 Aug. 21, 2003

Related U.S. Application Data

(60) Provisional application No. 60/318,970, filed on Sep. 13, 2001.

(51) Int. Cl.[7] ..... H01F 1/14; H01F 1/16

(52) U.S. Cl. ..... 148/120; 148/111

(58) Field of Search ..... 148/111, 112, 148/120, 121

(56) References Cited

U.S. PATENT DOCUMENTS 4,302,257 A * 11/1981 Matsumoto et al. ..... 148/111
4,718,951 A 1/1988 Schoen
5,545,263 A 8/1996 Yoshitomi et al.
6,322,639 B1 11/2001 Matsuzaki et al.
6,416,592 B2 7/2002 Kondo et al.

FOREIGN PATENT DOCUMENTS

JP 1-165722 * 6/1989 ..... 148/111

* cited by examiner

*Primary Examiner*—John Sheehan
(74) *Attorney, Agent, or Firm*—Frost Brown Todd LLC

(57) ABSTRACT

In a method of producing a strip suitable for further processing to yield a (110)[001] grain oriented electrical steel from a thin strip such as a continuously cast thin strip the thin cast strip is processed to promote recrystallization from the surface layer of the strip (S=0) into the quarter thickness of the strip (S=0.2 to 0.3). The process parameters are selected so that the strain/recrystallization parameter $(K^*)^{-1}$, ≧about 6500 and wherein, $$(K^*)^{-1} = (T_{HBA})\ln\left[\dot{\varepsilon}^{0.15}\exp\left(\frac{7616}{T_{HR}}\right)\ln\left(\frac{t_c}{t_f}\right)\right]$$

$T_{HBA}$ is the annealing temperature of the strip (in °Kelvin), $T_{HR}$ is the hot rolling temperature of the strip (in °Kelvin), $\dot{\varepsilon}$ is the strain rate of hot rolling, $t_i$ is the initial thickness of the strip before hot rolling, and $t_f$ is the final thickness of the strip after hot rolling.

3 Claims, 3 Drawing Sheets

METHOD OF PRODUCING (110)[001] GRAIN ORIENTED ELECTRICAL STEEL USING STRIP CASTING

CROSS-REFERENCE TO RELATED APPLICATION

This present application is related to and claims priority from U.S. Provisional Application No. 60/318,970, Schoen, et al., filed Sep. 13, 2001.

TECHNICAL FIELD

The present invention relates to a method for producing a strip suitable for further processing to yield a grain oriented electrical steel with low core loss and high magnetic permeability whereby the steel is produced from a steel melt which is first cast as a thin sheet or strip. It is subsequently processed to produce a finished strip of the desired thickness. The finished strip is preferably further subjected to at least one annealing treatment wherein the magnetic properties are developed, making the steel sheet of the present invention suitable for use in electrical machinery such as motors or transformers.

In particular, the present invention relates to a method of producing a strip suitable for further processing to yield a cube-on-edge oriented electrical steel strip and sheet. Cube-on-edge orientation is designated (110)[001] in accordance with the Miller Indices. In particular, the present invention provides a method of producing a (110)[001] grain oriented electrical steel from a thin strip such as a continuously cast thin strip. This thin cast strip is processed to promote recrystallization from the surface layer of the strip (S=0) into the quarter thickness of the strip (S=0.2 to 0.3). As used herein, the term S is used as a reference to a planar position through strip or sheet thickness. In the form used in this disclosure, the position of S=0 refers to the planar thickness position located at the very surface, or 0% of the thickness, of the strip; S=0.2–0.3 refers to the planar position located between 20% and 30% of the thickness of the strip; and, S=0.5 refers to the planar thickness position located halfway through the thickness of the strip.

BACKGROUND OF THE INVENTION

Grain oriented electrical steels are widely used as the magnetic core material in a variety of electrical machinery and devices, particularly in transformers where the highly directional magnetic properties developed in the sheet direction parallel to the rolling of the sheet can be utilized. Typical applications for grain oriented electrical steels include magnetic cores in power transformers, distribution transformers, large generators and a wide variety of small transformers. Core configurations can include sheared flat laminations, wound cores, segmental laminations for large generators, and some "E" and "I" types.

The performance of grain oriented electrical steels is typically characterized by a magnetic property called core loss, which is a measure of the power loss during magnetization in an alternating current (AC) field. Core loss is the electrical energy that is expended in the core steel without contributing to the work of the device. Core loss is reported in watts per kilogram using the SI system and in watts per pound using the English system. The core loss of a grain oriented electrical steel can be affected by volume resistivity of the sheet and the technical characteristics of the finished sheet such as the sheet thickness, the quality of the (110)[001] crystallographic texture of the sheet and intrinsic and extrinsic factors which affect the domain wall spacing, such as the size of (110)[001] grains in the finished sheet, the presence of a tension imparting coating onto the finished sheet or the application of a secondary treatment such as laser scribing to the surface of the finished sheet.

The production of grain oriented electrical steels requires vigorous and predictable conditions within which to effect secondary grain growth. Two prerequisite conditions for developing a high quality (110)[001] grain orientation are (1) the steel sheet must have a structure of recrystallized grains with the desired orientations prior to the high temperature portion on the final annealing step wherein a process known as secondary grain growth occurs; and (2) the presence of a grain growth inhibitor to restrain primary grain growth in the final annealing step until secondary grain growth is substantially completed. The first precondition requires that the steel sheet and in particular, the surface and near-surface areas of the steel sheet, have a recrystallized grain structure and crystallographic texture appropriate for secondary grain growth. The (110)[001] grains that experience vigorous secondary grain growth are typically located in these surface and near-surface areas of the sheet. The second precondition requires a phase to inhibit primary grain growth while allowing these primary grains to be consumed by growing (110)[001] grains. A dispersion of fine particles, such as manganese sulfides and/or selenides, aluminum nitrides, or both, are effective and well-known means of providing primary grain growth inhibition.

Grain oriented electrical steels are further characterized by the type of the grain growth inhibitors used, the processing steps used and the level of magnetic properties developed. Typically, grain oriented electrical steels are separated into two classifications, conventional (or regular) grain oriented and high permeability grain oriented, based on the level of the magnetic permeability obtained in the finished steel sheet.

The magnetic permeability of grain oriented electrical steels is affected by the quality of the crystal orientation of the finished steel sheet. The processing of oriented electrical steel results in most of the grains being arranged so that edges of the unit cubes comprising each grain are aligned parallel to the rolling direction in a cube-on-edge position with face diagonals aligned in the transverse direction. Because each cube is most easily magnetized along its edge, the [001] direction, the magnetic properties of oriented electrical steels are typically best in the rolling direction. The face diagonal, the [110] direction, of each cube is typically more difficult to magnetize than the cube edge and the cube diagonal, the [111] direction, is generally the most difficult to magnetize. Thus, in a typical grain oriented electrical steel, the magnetic properties are typically best in the rolling direction, poorer at 90° to the rolling direction, and poorest at 55°. The magnetic permeability of grain oriented electrical steels, typically measured at a magnetic field density of 796 A/m, provides a measurement of the quality of the (110)[001] grain orientation in the rolling direction of the finished steel sheet.

Conventional grain oriented electrical steels typically have magnetic permeability measured at 796 A/m of greater than 1700 and below 1880. Regular grain oriented electrical steels typically contain manganese and sulfur (and/or selenium) that combine to form the principal grain growth inhibitor(s) and are processed using one or two cold reduction steps with an annealing step typically used between cold reductions steps. Aluminum is generally less than 0.005% and other elements, such as antimony, copper, boron and nitrogen, may be used to supplement the inhibitor system to provide grain growth inhibition. Conventional grain oriented electrical steels are well known in the art. U.S. Pat. Nos. 5,288,735 and 5,702,539, incorporated herein by reference, describe exemplary processes for the production of conventional grain oriented electrical steel.

High permeability grain oriented electrical steels typically have magnetic permeability measured at 796 A/m of greater than 1880 and below 1980. High permeability grain oriented electrical steels typically contain aluminum and nitrogen that combine to form the principal grain growth inhibitor with one or two cold reduction steps with an annealing step typically used prior to the final cold reductions step. Other additions can be employed to supplement the grain growth inhibition of the aluminum nitride phase. Such additions can include manganese, sulfur and/or selenium, tin, antimony, copper and boron. High permeability grain oriented electrical steels are well known in the art. U.S. Pat. Nos. 3,853,641 and 3,287,183, incorporated herein by reference, describe exemplary methods for the production of high permeability grain oriented electrical steel.

Grain oriented electrical steels are typically produced using ingots or continuously cast slabs as the starting material. Using these conventional production methods, grain oriented electrical steels are processed wherein the starting cast slabs or ingots are heated to an elevated temperature, typically in the range of from about 2192° F. (1200° C.) to about 2552° F. (1400° C.), and hot rolled into a strip, typically having a thickness of from about 0.06" (1.5 mm) to about 0.16" (4.0 mm), which is suitable for further processing.

Slab reheating dissolves the grain growth inhibitors that are subsequently precipitated to form a fine dispersed grain growth inhibitor phase. The inhibitor precipitation can be accomplished during or after the step of hot rolling, annealing of the hot rolled strip, and/or annealing of the cold rolled strip. Breakdown rolling of the slab or ingot prior to reheating of the slab or ingot in preparation for hot rolling may be employed in the production of grain oriented electrical steels. U.S. Pat. Nos. 3,764,406 and 4,718,951, incorporated herein by reference, describe exemplary prior art methods for the breakdown rolling, slab reheating and hot strip rolling used for the production of grain oriented electrical steels.

In addition, the strip usually undergoes one or more cold reduction steps. The strip is annealed between multiple cold reductions. The end result of this processing is a thin sheet material, typically having a thickness of from about 0.06" (1.5 mm) to about 0.16" (4.0 mm), which is suitable for further processing.

Typical, conventional methods used to process grain oriented electrical steels may include hot band annealing, pickling of the hot rolled or hot rolled and annealed strip, one or more cold rolling steps, an annealing step between cold rolling steps and a decarburization annealing step between cold rolling steps or after cold rolling to final thickness. The decarburized strip is subsequently coated with an annealing separator coating and subjected to a high temperature final annealing step wherein the (110)[001] grain orientation is developed.

A strip casting process is advantageous for the production of a grain oriented electrical steel because a number of the conventional processing steps used to produce a strip suitable for further processing can be eliminated. Strip casting apparatuses and methods for the production of carbon steels and stainless steels are well known in the art, e.g., U.S. Pat. Nos. 6,257,315; 6,237,673; 6,164,366; 6,152,210; 6,129,136; 6,032,722; 5,983,981; 5,924,476; 5,871,039; 5,816,311; 5,810,070; 5,720,335; 5,477,911; 5,049,204, all of which are incorporated herein by reference.

When employing a strip casting process, at least one casting roll and, preferably, two counter rotating casting rolls are used to produce a strip that is less than about 0.39" (10 mm) in thickness and, preferably, less than about 0.20" (5 mm) in thickness and, more preferably, about 0.12" (3 mm) in thickness. The processing steps which can be eliminated can include, but are not limited to, slab or ingot casting, slab or ingot reheating, slab or ingot breakdown rolling, hot roughing and/or hot strip rolling. Moreover, with the combined use of hot rolling of a thin cast strip for the production of carbon steel and stainless steels, the amount of hot reduction necessary is minimized.

It is well known in the art, for both carbon steels and stainless steels, that the application of a hot reduction to a thin cast strip can be useful to improve the surface characteristics of the finished strip. A thin cast strip often has shrinkage porosity that must be closed to provide a strip with the desired physical and mechanical properties. In addition, textured casting rolls are commonly used for the direct casting of strip. The surface roughness of the as-cast strip reflects the surface roughness of the casting rolls, making the surface of a cast strip less desirable for many applications where a smooth, high quality surface is required.

The application of strip casting to the production of grain oriented electrical steels differs from stainless steels and carbon steels made using strip casting because of different technical requirements for the grain structure, texture and grain growth inhibition (such as MnS, MnSe, AlN and the like), which are preconditions for producing the desired (110)[001] texture by the process of secondary grain growth. Thus, the present invention provides for the production of a strip suitable for further processing to yield a high quality (110)[001] grain oriented electrical sheet from a thin cast ingot or strip.

SUMMARY OF THE INVENTION

The present invention provides a method of producing a strip suitable for further processing to yield a (110)[001] grain oriented electrical steel comprising the steps of:

a. obtaining a cast strip having a thickness of less than or equal to about 0.39 in (10 mm);

b. hot rolling the cast strip;

c. annealing the hot rolled strip; and d. having a strain/recrystalization parameter, $(K^*)^{-1}$, ≧about 6500;

wherein, $$(K^*)^{-1} = (T_{HBA})\ln\left[\dot{\epsilon}^{0.15}\exp\left(\frac{7616}{T_{HR}}\right)\ln\left(\frac{t_c}{t_f}\right)\right]$$

$T_{HBA}$ is the annealing temperature of the strip (in °Kelvin),
$T_{HR}$ is the hot rolling temperature of the strip (in °Kelvin),
$\dot{\epsilon}$ is the strain rate of hot rolling,
$t_i$ is the initial thickness of the strip before hot rolling, and
$t_f$ is the final thickness of the strip after hot rolling.

DETAILED DESCRIPTION OF THE INVENTION

Figure 1:
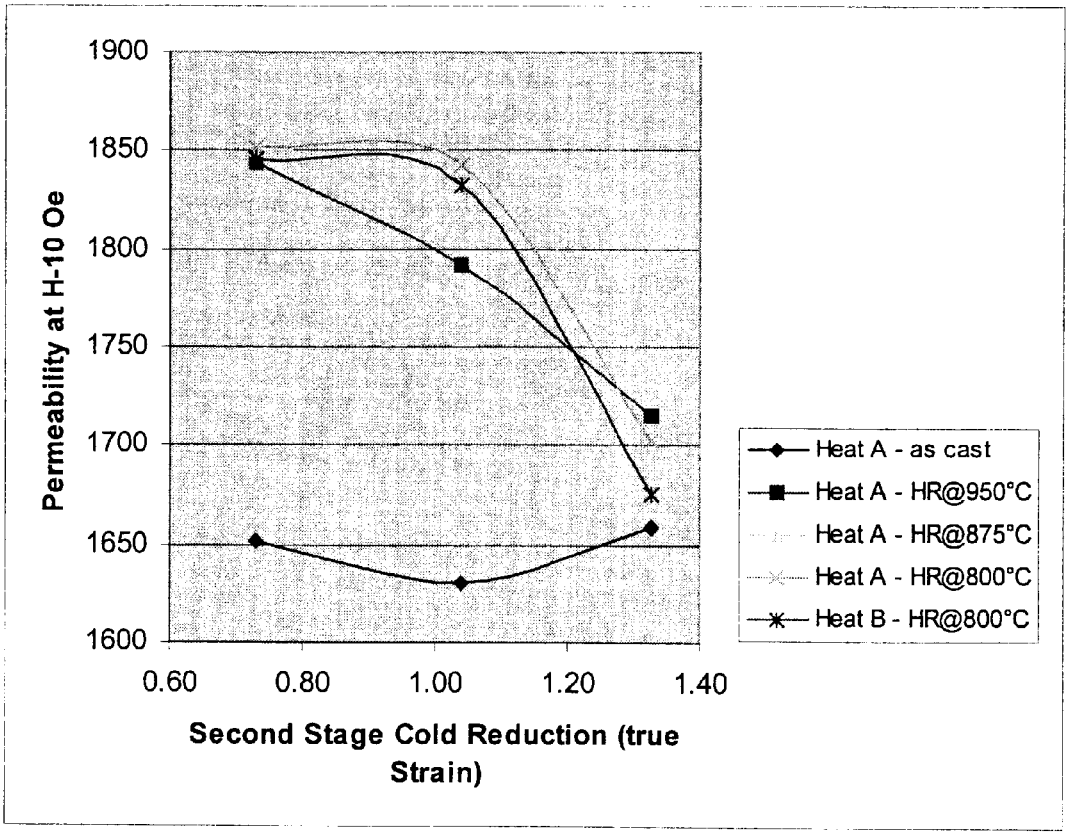
FIG. 1 is a graphic representation of the H-10 permeability vs. second stage cold reduction (true strain) of the samples of Example 1.

The production of a high quality (110)[001] grain oriented electrical steel sheet requires that, prior to the start of secondary grain growth, the steel sheet must have a recrystallized microstructure consisting of nuclei grains that will form (110)[001] secondary grains within a matrix of primary grains of other orientations which are readily consumed by the growing (110)[001] secondary grains. In conventional thick slab casting, it is known that the microstructure and texture development is initiated in the process of slab reheating and hot strip rolling. It is further known that the presence of a large proportion of unrecrystallized (or "refractory") grains in the microstructure of the hot rolled strip may impair the development of the desired (110)[001] orientation in the final grain oriented electrical steel sheet.

This can be particularly acute when a single stage cold reduction process is employed which can produce a poorer texture, particularly with respect to the (110)[001] nuclei, than when two or more cold reduction and annealing steps are employed. The microstructure and recrystallization texture of the surface (S=0) and near-surface (S=0.2–0.3) layers of the strip are particularly important as it is in this region where secondary grain growth will most likely be initiated.

Microstructural studies of conventional grain oriented electrical steels made using thin cast strip specimens demonstrate that insufficient recrystallization during annealing of the cast strip can be obtained unless a hot or cold reduction step has been performed. A thin cast strip, subjected to a hot rolling step at a temperature of about 1697° F. (925° C.), can show incomplete recrystallization in the surface (S=0) and near-surface (S=0.2 to 0.3) layers, after annealing at a temperature of about 1832° F. (1000° C.). These specimens, when processed using either one or two stages of cold reduction, fail to produce vigorous secondary grain growth and typically produce permeability measured at 796 W/m of less than 1800.

Using the proper combination of the hot rolling temperature and the amount of reduction can provide substantial recrystallization in the surface and near-surface layers of the cast, hot rolled and annealed strip. These specimens, when processed using either on or two stages of cold reduction, produce vigorous secondary grain growth and can typically produce a magnetic permeability at 796 A/m of from 1820 to 1850.

A mathematical model has been developed that describes how the processing conditions used for casting, hot rolling and annealing affect the deformation strain/recrystallization behavior of thin cast, hot rolled and annealed strip. This model describes the interrelationship among process parameters that permit the manufacture of a thin substrate, in particular a thin cast strip, having a highly recrystallized microstructure suitable for further processing into a grain oriented electrical steel sheet.

The method of the present invention enables the determination of the processing parameters and requirements, including thickness of the cast strip, the temperature at which the cast strip is hot rolled, the amount of reduction and the rate of reduction taken in hot rolling, and the temperature used to anneal the cast and hot rolled strip which can provide a microstructure having sufficient recrystallization prior to cold rolling. The method of the present invention aids in determining the specific process requirements for strip casting, hot band rolling, cold rolling and hot band annealing necessary to produce a desired strip thickness. Using the present invention, the parameters needed for high production rates can be determined, particularly for a strip casting process. The development of the construct for the deformation strain/recrystallization model is, in part, based on a mathematical model described in U.S. Pat. No. 4,718,951, incorporated herein by reference. That model was directed to optimizing the recrystallization in a thick cast slab.

In the method of the present invention, the thin cast strip can be hot rolled and annealed to provide a strip suitable for further processing to provide a grain oriented electrical steel having excellent magnetic properties. The hot rolling and annealing can occur as two discrete operations or they can be conducted as a tandem operation. Better magnetic properties can be obtained when the hot rolling and hot band annealing conditions provide substantial recrystallization of the cast microstructure prior to cold rolling to final thickness.

In one embodiment of the present invention, the deformation conditions for hot rolling are modeled to determine the requirements for hot deformation whereby the strain energy imparted from hot rolling is sufficient to foster extensive recrystallization of the cast strip. This model is outlined in Equations I through VII.

The strain energy imparted from rolling can be calculated as:

$$W = \theta_c \ln\left(\frac{1}{1-R}\right) \tag{I}$$

Wherein W is the work expended in rolling, $\theta_c$ is the constrained yield strength of the steel and R is the amount of reduction taken in rolling in decimal fraction, i.e., initial thickness of the cast strip ($t_c$, in mm) divided by the final thickness of the cast and hot rolled strip ($t_f$, in mm). The true strain in hot rolling can be further calculated as:

$$\epsilon = K_1 W \tag{II}$$

Where $\epsilon$ is the true strain and $K_1$ is a constant. Combining Equation I into Equation II, the true strain in hot rolling can be calculated as:

$$\varepsilon = K_1 \theta_c \ln\left(\frac{t_c}{t_f}\right) \tag{III}$$

The constrained yield strength, $\theta_c$, is related to the yield strength of the cast steel strip when hot rolling. In hot rolling, recovery occurs dynamically and thus strain hardening during hot rolling is considered not to occur in the method of the invention. However, the yield strength depends markedly on the temperature and strain rate and the applicants have thereby incorporated a solution based on the Zener-Holloman relationship whereby the yield strength is calculated based on the the temperature of deformation and the rate of deformation, also termed as the strain rate, as follows.

$$\theta_T = 4.019\dot{\varepsilon}^{0.15} \exp\left(\frac{7616}{T}\right) \tag{IV}$$

Where $\theta_T$ is the temperature and strain rate compensated yield strength of the steel during rolling, $\dot{\epsilon}$ is the strain rate of rolling and T is the temperature, in ° K, of the steel when rolled. For the purposes of the present invention, $\theta_T$ of Equation IV is substituted for $\theta_c$ in Equation III to obtain:

$$\varepsilon = K_2\dot{\varepsilon}^{0.15}\exp\left(\frac{7616}{T}\right)\ln\left(\frac{t_c}{t_f}\right), \quad \text{(V)}$$

where $K_2$ is a constant.

Given the deformation gradients common in rolling of thin strip, it is often difficult to determine the specific strain rate in the surface (S=0) and near-surface (S=0.2–0.3) region of the strip. Accordingly, Equation VI is used to provide a simplified method to calculate the mean strain rate, $\dot{\epsilon}_m$, in hot rolling as:

$$\dot{\varepsilon}_m = K_3\frac{2\pi Dn}{\sqrt{Dt_c}}\sqrt{\frac{t_c - t_f}{t_c}}\left[1 + \frac{1}{4}\left(\frac{t_c - t_f}{t_c}\right)\right] \quad \text{(VI)}$$

Where D is the work roll diameter in mm, n is the roll rotational rate in revolutions per second and $K_3$ is a constant. The above expressions can be rearranged and simplified by substituting $\dot{\epsilon}_m$ of Equation VI for $\dot{\epsilon}$ of Equation V and assigning a value of 1 to the constants, $K_1$, $K_2$ and $K_3$, whereby the nominal hot rolling strain, $\epsilon_{nominal}$, can be calculated as shown in Equation VIII as:

$$\varepsilon_{nominal} = \left[\frac{2\pi n}{t_c}\sqrt{D(t_c - t_f)}\left(1.25 - \frac{t_f}{4t_f}\right)\right]^{0.15}\exp\left(\frac{7616}{T}\right)\ln\left(\frac{t_c}{t_f}\right) \quad \text{(VII)}$$

The final component of the model is the relationship between hot rolling strain, $\epsilon_{nominal}$, provided to the cast strip per Equation VII and the recrystallized grain size, $d_{REX}$, of the strip after annealing. Based on established recrystallization principle shown in Equation VIII, the recrystallized grain size, $d_{REX}$, is also influenced by the initial grain size of the cast strip, $d_o$, and the rate of recrystallization nuclei formation and grain growth, D:

$$d_{REX} = \epsilon^{-1}d_oD \quad \text{(VIII)}$$

Additionally, the rate of recrystallization nuclei formation and grain growth, D, is dependent on a diffusion process within the steel when annealing and, thereby, is dependent on the activation energy for recrystallization and grain growth, $Q_{REX}$, and the annealing temperature, $T_{HBA}$, as shown in Equation IX:

$$D = D_o\exp\left(\frac{-Q_{REX}}{RT_{HBA}}\right) \quad \text{(IX)}$$

where R is Boltzmann's constant and $D_o$ is a reference value for the rate of diffusion of iron. For the purposes of the present invention, it has been found that changes in $d_o$ do not appear to have a significant effect and $d_o$ can be eliminated from Equation VIII, which allows Equation VIII to be reduced to:

$$d_{REX} = C_1\epsilon^{-1}D \quad \text{(X)}$$

where $C_1$ is a constant. To converge towards the single deformation strain/recrystallization model, D of Equation IX is substituted into Equation VIII which can be rearranged to Equation XI:

$$\frac{1}{T_{HBA}} = \left(\frac{R}{-Q_{REX}}\right)\ln\left(\frac{d_{REX}\varepsilon}{C_2}\right) \quad \text{(XI)}$$

where $C_2$ is a constant. Assuming the recrystallized grain size is a constant, Equation XI can be reduced to:

$$\frac{1}{T_{HBA}} = C_3\ln\varepsilon \quad \text{(XII)}$$

where $C_3$ is a single constant that combining R, $Q_{REX}$, $d_{REX}$ and $C_2$. Equation XII can be further rearranged to:

$$\frac{1}{T_{HBA}} = C_3\ln\varepsilon, \text{ or} \quad \text{(XIII)}$$

$$\frac{1}{C_3} = T_{HBA}\ln\varepsilon \quad \text{(XIV)}$$

The nominal strain from hot rolling, $\epsilon_{nominal}$, of Equation VII can then be substituted into Equation XIV to obtain:

$$(K^*)^{-1} = (T_{HBA})\ln\left[\dot{\varepsilon}^{0.15}\exp\left(\frac{7616}{T_{HR}}\right)\ln\left(\frac{t_c}{t_f}\right)\right] \quad \text{(XV)}$$

where $(K^*)^{-1}$ is defined as the deformation strain/recrystallization parameter.

In an embodiment of the present invention, the deformation strain/recrystallization parameter, $(K^*)^{-1}$, is greater than or equal to about 7,000. In another embodiment, the deformation strain/recrystallization parameter, $(K^*)^{-1}$, is greater than or equal to about 8,000.

In an embodiment of the present invention, the annealing of the cast and hot rolled strip may be carried out using a strip type continuous anneal where the hot rolled strip is heated to a temperature typically greater than about 1472° F. (800° C.). In another embodiment, the hot rolled strip is heated to a temperature typically greater than about 1832° F. (1000° C.), for a time less than about 10 minutes.

In the method of the present invention, a strip or band having a thickness of about 0.39" (10 mm) or thinner is cast by any method known in the art and, more preferably, using the method of twin roll strip casting. In one embodiment of the present invention, the cast strip is subjected to rapid cooling in accordance with the method described in co-pending non-provisional patent application Ser. No. 10/243,020, entitled Method of Continuously Casting Electrical Steel Strip With Controlled Spray Cooling, filed Sep. 13, 2002, and claiming priority from Patent Application Serial No. 60/318,971, filed Sep. 13, 2001.

In the method of the present invention, the cast strip can be directly cooled to the temperature desired for hot rolling, preferably in a single pass, or optionally the cast and cooled strip may be reheated to the desired temperature for hot rolling. Reheating of the cast strip prior to hot rolling can be beneficial in that any temperature gradients introduced in the strip during cooling after strip casting or in any secondary cooling can be reduced or eliminated. The cast and hot rolled strip is subsequently annealed, another process that is well-known in the art, to effect substantial recrystallization of the grain structure. The hot rolling and annealing processes should provide a deformation strain/recrystallization parameter, $(K^*)^{-1}$, of greater than or equal to about 6500.

The above described processes may be conducted as individual processes or combined in part or wholly into a continuous sequence of processes.

EXAMPLE 1

A series of laboratory heats are melted to the compositions shown in Table I. The steel melts are heated to a temperature of between about 1525° C. to 1565° C., are cast into thin sheet specimens having of a thickness of either about 2 mm or 3 mm and subjected to rapid cooling to below a temperature of below 700° C.

TABLE I

| | Heat compositions - all elements reported in weight percent | | | | | | | | | | | | | | | |
|---|---|---|---|---|---|---|---|---|---|---|---|---|---|---|---|---|
| Heat | C | Mn | P | S | Si | Cr | Ni | Mo | Cu | Ti | Al | N | O | Nb | V | B |
| A | 0.031 | 0.056 | <0.002 | 0.022 | 2.99 | 0.25 | 0.08 | <0.002 | 0.07 | <.002 | <.001 | 0.002 | 0.003 | <.002 | <.002 | <0.0002 |
| B | 0.024 | 0.055 | <0.002 | 0.024 | 3.11 | 0.34 | 0.08 | <0.002 | 0.08 | <.002 | <.001 | 0.003 | 0.003 | <.002 | <.002 | <0.0002 |

The sheets are processed in two fashions. The 2 mm thick sheets are further processed in the cast condition after annealing at a temperature of 1050° C. while the 3 mm thick are hot rolled to a nominal thickness of 2 mm using the conditions shown in Table II.

TABLE II

| | | | | Heat 97041/97042 | | | Heat 97036 | | |
|---|---|---|---|---|---|---|---|---|---|
| Hot Roll | $(K^*)^{-1}$ | Intermed. Cold Rolled Gauge | Second Stage Cold Reduction (true strain) | Sample ID | H10 Perm | P15; 60 Core Loss W/lb | Sample ID | H10 Perm | P15; 60 Core Loss W/lb |
| none | | 1.00 mm | 1.33 | H4A | 1659 | 0.624 | | | |
| | | 0.75 mm | 1.04 | H3A | 1631 | 0.655 | | | |
| | | 0.55 mm | 0.73 | H2A | 1652 | 0.605 | | | |
| 950° C. | 7117 | 1.00 mm | 1.33 | K4A | 1715 | 0.548 | | | |
| | 7117 | 0.75 mm | 1.04 | K3A | 1792 | 0.499 | | | |
| | 7117 | 0.55 mm | 0.73 | K3A | 1844 | 0.500 | | | |
| 875° C. | 7637 | 1.00 mm | 1.33 | L4A | 1741 | 0.577 | | | |
| | 7637 | 0.75 mm | 1.04 | L3A | 1846 | 0.456 | | | |
| | 7637 | 0.55 mm | 0.73 | L2A | 1850 | 0.478 | | | |
| 800° C. | 8235 | 1.00 mm | 1.33 | J4A | 1703 | 0.515 | G4A | 1676 | 0.589 |
| | 8235 | 0.75 mm | 1.04 | J3A | 1843 | 0.448 | G3A | 1832 | 0.440 |
| | 8235 | 0.55 mm | 0.73 | J2A | 1851 | 0.463 | G2A | 1846 | 0.463 |

The cast strip samples subjected to a hot rolling treatment before annealing are first heated to a temperature of about 1035° C. in a non-oxidizing atmosphere and cooling in air before being subjected to a single pass hot reductions of between about 30%, about 40% and about 50% at temperatures ranging of from about 815° C., about 900° C. and about 980° C. The resulting hot rolled strips are annealed at a temperature of about 1050° C., providing the $(K^*)^{-1}$ values shown in Table II, before further processing.

After annealing, both the cast and cast-and-hot rolled specimens are cold rolled to an intermediate thickness of about 0.45 mm or about 0.60 mm. The intermediate cold rolled specimens are intermediate annealed at a temperature of about 980° C. and further cold rolled to a final thickness of about 0.27 mm.

The cold rolled samples are subsequently decarburization annealed in a humidified hydrogen-nitrogen atmosphere at a temperature of about 875° C. for a time sufficient to lower the carbon to less than 0.0025% and coated with an annealing separator coating comprised substantially of magnesium oxide. The decarburized and coated sheets are then subjected to a final high temperature annealing step in a hydrogen atmosphere, being heated to and held at a temperature of about 1150° C. for a time of about 15 hours to effect secondary grain growth and remove impurities such as sulfur and nitrogen from the finished grain oriented electrical steel sheet, after which the samples are tested for magnetic permeability at 796 A/m results are shown in FIG. 1.

Figure 2:
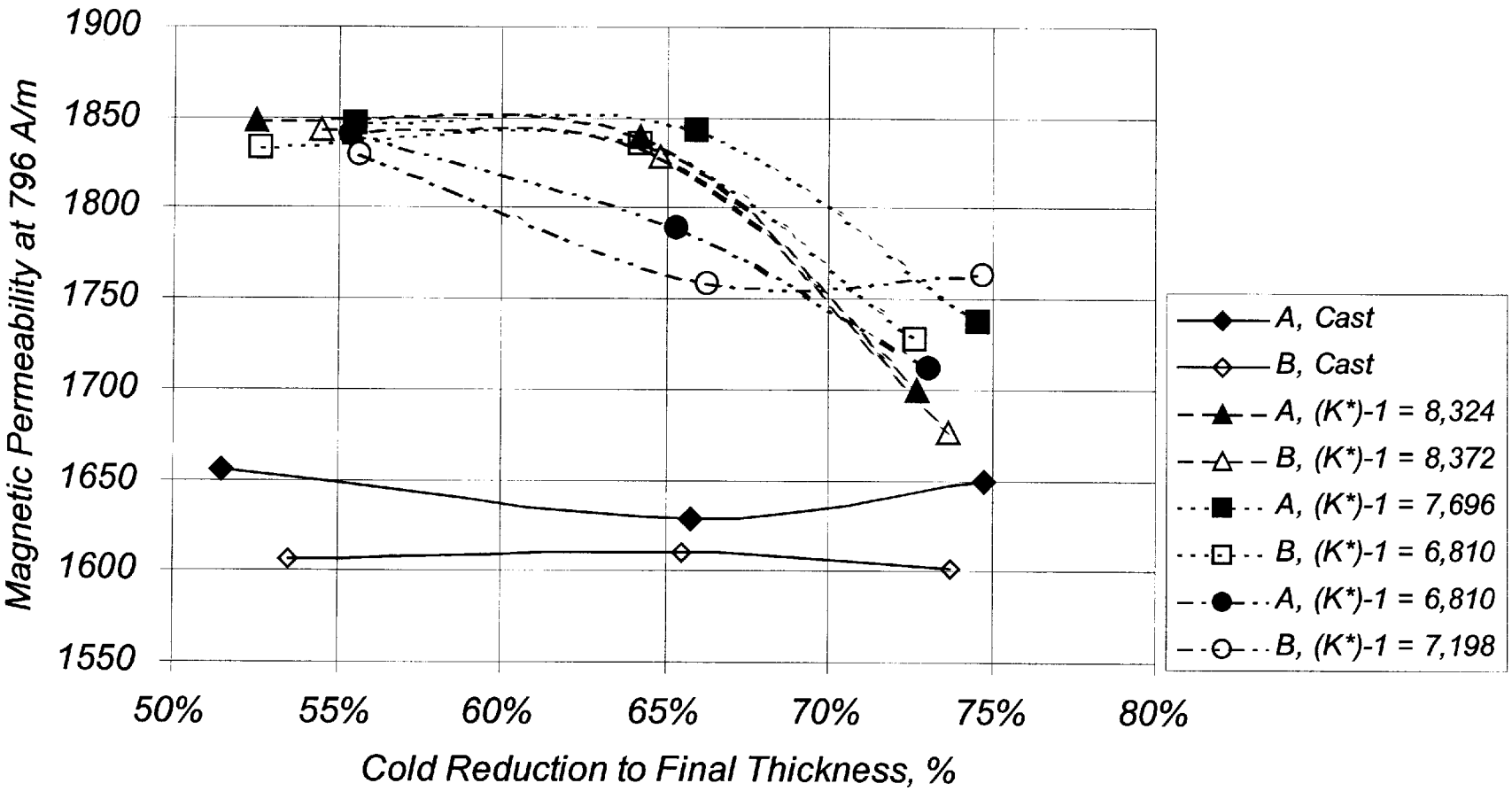
FIG. 2 is a graphic representation of the magnetic permeability at 796 A/m vs. cold reduction to final thickness, %, of Example 1.

These results show that poor secondary grain growth can be obtained on samples directly processed from a cast and annealed strip; however, using the hot reduction method of the present invention, the cast, hot rolled and annealed strip produces very good and consistent magnetic permeability at 796 A/m and core losses typical of a 0.27 mm thick conventional grain oriented electrical steel sheet. The magnetic permeability data are also presented in FIG. 2 which further shows that values of $(K^*)^{-1}$ greater than or equal to about 6,500 can produce stable secondary grain growth, and that the use of $(K^*)^{-1}$ above about 7,000 produced much more vigorous secondary grain growth.

EXAMPLE 2

A steel melt is prepared having the composition shown in Table III, heated to a temperature of above about 1565° C. and cast into the form of thin sheet of a thickness of about 2.7 mm using a twin roll strip casting machine. After the strip exits the casting process, the strip is cooled at a rate of less than about 15° C. per second about to a temperature of about 1230° C. at which temperature, the cast strip is subjected to rapid cooling at a rate of about 100° C. per second to a temperature of below about 700° C. The cast strip is then coiled at a temperature of below about 650° C. and subsequently cooled to ambient temperature.

TABLE III

| Heat | C | Mn | P | S | Si | Cr | Ni | Mo | Cu | Ti | Al | V | B | N | O |
|---|---|---|---|---|---|---|---|---|---|---|---|---|---|---|---|
| | Heat compositions - all elements reported in weight percent | | | | | | | | | | | | | | |
| C | .033 | .051 | <.002 | .026 | 2.94 | .25 | .080 | <.002 | .082 | <.002 | .0005 | <.002 | <.0003 | .0065 | <.005 |

The cast sheet is cut into a series of samples for laboratory processing wherein the sheets are reheated to a temperature of about 1025° C. in a non-oxidizing atmosphere and cooled in air to varying temperatures and hot rolled in a single pass to varying thickness as shown in Table IV. The resulting hot rolled sheets are then annealed at a temperature of about 1050° C., providing the $(K^*)^{-1}$ values of between about 7,000 and about 9,000. After hot band annealing, the samples are cold rolled to an intermediate thickness of about 0.56 mm, annealed at a temperature of about 980° C. and further cold rolled to a final thickness of about 0.27 mm. The cold rolled samples are subsequently decarburization annealed in a humidified hydrogen-nitrogen atmosphere at a temperature of about 875° C. for a time sufficient to lower the carbon to less than 0.0025% and coated with an annealing separator coating comprised substantially of magnesium oxide (MgO). The decarburized and coated sheets are then subjected to a final high temperature annealing step in a hydrogen atmosphere, being heated to and held at a temperature of about 1150° C. for a time of about 15 hours to effect secondary grain growth and remove impurities such as sulfur and nitrogen from the finished grain oriented electrical steel sheet, after which the samples are tested for magnetic permeability at 796 A/m which results are shown in Table IV.

Figure 3:
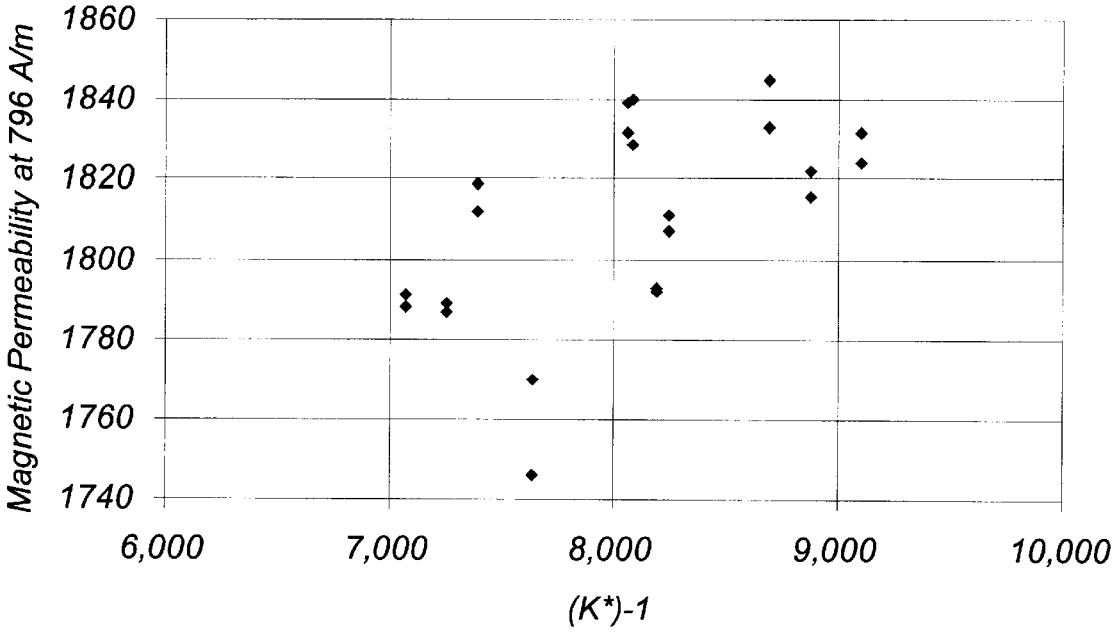
FIG. 3 is a graphic representation of the magnetic permeability at 796 A/m vs. calculated strain/recrystallization parameter $(K^*)^{-1}$ of Example 2.

These results show that good secondary grain growth can be obtained on samples made from a twin roll cast strip which is further hot rolled and annealed using the method of the present invention. As Table IV shows, the cast, hot rolled and annealed strip of the present invention produce very good and consistent magnetic permeability at 796 A/m typical of a 0.27 mm thick conventional grain oriented electrical steel sheet. The magnetic permeability data are presented in FIG. 3 shows that increasing the value of $(K^*)^{-1}$ above about 6,500 better results owing to more stable secondary grain growth.

These results show that vigorous secondary grain growth can be obtained using the method of the present invention whereby a cast, hot rolled and annealed strip can be used to produce a grain oriented electrical steel strip with good magnetic properties.

TABLE IV

| Heat | Processing Method | Cast Thickness, mm | Hot Rolling Temperature, ° C. | Hot Rolled Thickness, mm | $(K^*)^{-1}$ | Intermediate Thickness, mm | Sample ID | Final Thickness, mm | Final Cold Reduction, % | Permeability at 796 A/m |
|---|---|---|---|---|---|---|---|---|---|---|
| C | Hot rolled | 2.67 | 815 | 1.47 | 8,875 | 0.56 | 7-S | 0.273 | 51% | 1816 |
| | | | | 1.47 | 8,875 | 0.56 | 7-S | 0.272 | 51% | 1822 |
| | | | | 1.60 | 8,190 | 0.56 | 5-S | 0.271 | 51% | 1792 |
| | | | | 1.60 | 8,190 | 0.56 | 5-S | 0.266 | 52% | 1793 |
| | | | | 1.60 | 7,636 | 0.56 | 4-S | 0.267 | 52% | 1746 |
| | | | | 1.60 | 7,068 | 0.56 | 13-S | 0.270 | 52% | 1788 |
| | | | 895 | 1.35 | 8,243 | 0.56 | 6-S | 0.271 | 52% | 1807 |
| | | | | 1.35 | 8,243 | 0.56 | 6-S | 0.270 | 52% | 1811 |
| | | | | 1.37 | 9,099 | 0.56 | 19-S | 0.267 | 52% | 1832 |
| | | | | 1.37 | 9,099 | 0.56 | 19-S | 0.266 | 52% | 1824 |
| | | | | 1.57 | 8,689 | 0.56 | 18-S | 0.271 | 51% | 1833 |
| | | | | 1.57 | 8,689 | 0.56 | 18-S | 0.271 | 52% | 1845 |
| | | | | 1.60 | 7,636 | 0.56 | 4-S | 0.271 | 52% | 1770 |
| | | | | 1.60 | 7,250 | 0.56 | 12-S | 0.270 | 52% | 1789 |
| | | | | 1.93 | 8,065 | 0.56 | 15-S | 0.272 | 51% | 1832 |
| | | | | 1.93 | 8,065 | 0.56 | 15-S | 0.274 | 51% | 1839 |
| | | | | 1.93 | 8,082 | 0.56 | 17-S | 0.271 | 52% | 1840 |
| | | | | 1.93 | 8,082 | 0.56 | 17-S | 0.270 | 52% | 1829 |
| | | | 960 | 1.47 | 7,394 | 0.56 | 14-S | 0.272 | 51% | 1819 |
| | | | | 1.47 | 7,394 | 0.56 | 14-S | 0.271 | 51% | 1812 |
| | | | | 1.60 | 7,250 | 0.56 | 12-S | 0.271 | 51% | 1787 |
| | | | | 1.60 | 7,068 | 0.56 | 13-S | 0.270 | 52% | 1791 |

What is claimed is:

1. A method of producing a strip suitable for further processing to yield a (110)[001] grain oriented electrical steel comprising the steps of:

a. obtaining a strip having an initial thickness of ≦0.39 in (10 mm);

b. hot rolling the strip of step a;

c. annealing the strip of step b; and d. having a strain/recrystallization parameter, $(K^*)^{-1}$, ≧about 6500;

wherein, $$(K^*)^{-1} = (T_{HBA})\ln\left[\dot{\epsilon}^{0.15}\exp\left(\frac{7616}{T_{HR}}\right)\ln\left(\frac{t_c}{t_f}\right)\right]$$

$T_{HBA}$ is the annealing temperature of the strip of step c (in °Kelvin), $T_{HR}$ is the hot rolling temperature of the strip of step b (in °Kelvin), $\dot{\epsilon}$ is the strain rate of hot rolling, $t_i$ is the initial thickness of the strip in step a before hot rolling, and $t_f$ is the final thickness of the strip after hot rolling of step b.

2. The method of claim 1 wherein $(K^*)^{-1} \geqq$ about 7000.

3. The method of claim 1 wherein $(K^*)^{-1} \geqq$ about 8000.

* * * * *